US005769703A

United States Patent [19]

Conlin

[11] Patent Number: 5,769,703

[45] Date of Patent: Jun. 23, 1998

[54] PAINT SPRAY BOOTH WITH PROTECTIVE CURTAIN

[76] Inventor: Douglas Conlin, 737 Ambleside Dr., Wilmington, Del. 19808

[21] Appl. No.: 764,993

[22] Filed: Dec. 16, 1996

Related U.S. Application Data

[60] Provisional application No. 60/010,389, Jan. 23, 1996.

[51] Int. Cl. [6] ..... B05B 15/12

[52] U.S. Cl. ..... 454/50; 118/634

[58] Field of Search ..... 454/50, 51, 52, 454/53, 54, 55; 118/326, 634, DIG. 7

[56] References Cited

U.S. PATENT DOCUMENTS

| | | | |
|---|---|---|---|
| 2,991,188 | 7/1961 | Wing et al. . | |
| 3,496,856 | 2/1970 | Wiggins . | |
| 3,741,155 | 6/1973 | Hunder | 454/51 X |
| 4,207,833 | 6/1980 | Napadow . | |
| 4,231,289 | 11/1980 | Domicent | 454/52 |
| 4,469,595 | 9/1984 | Napadow . | |
| 4,484,513 | 11/1984 | Napadow . | |
| 4,693,048 | 9/1987 | Guetersloh . | |
| 4,748,049 | 5/1988 | Charles et al. . | |
| 5,201,954 | 4/1993 | Holt | 118/326 X |
| 5,236,506 | 8/1993 | Mazakas | 118/634 |
| 5,240,504 | 8/1993 | Mazakas | 118/634 |

FOREIGN PATENT DOCUMENTS

| | | | |
|---|---|---|---|
| 27 04 497 | 8/1978 | Germany | 118/326 |

*Primary Examiner*—Harold Joyce

[57] ABSTRACT

A protective curtain or liner is detachably mounted to the walls of a paint spray booth so that the paint which would otherwise contact walls would instead contact the curtain and the paint would then be disposed of by removing the curtain.

19 Claims, 2 Drawing Sheets

PAINT SPRAY BOOTH WITH PROTECTIVE CURTAIN

CROSS-REFERENCE TO RELATED APPLICATION

This application is based on provisional patent application Ser. No. 60/010,389, filed Jan. 23, 1996.

BACKGROUND OF THE INVENTION

Various techniques have been attempted in the prior art to address the problem of volatile organic compounds in a paint spray room or booth. Such techniques have included the provision of liquid masking and strippers. It would be desirable if some technique could be provided which lends itself to a manner of convenient use at low cost.

SUMMARY OF THE INVENTION

An object of this invention is to provide a paint spray booth having a detachable protective curtain.

A further object of this invention is to provide such a paint spray booth with a protective curtain which can be easily mounted to and removed from a wall of such a booth.

In accordance with this invention the curtain in one embodiment thereof is provided with snap fasteners for engagement with mating fasteners permanently secured to the wall. The snap fasteners can be provided at the top and bottom of the curtain as well as intermediate areas.

Alternatively, other means of detachment such as pressure sensitive adhesive could be used as a light duty version of the snap fasteners.

The curtains may be made of any suitable material, including PTFE or TEFLON® which would be particularly effective not only because paint would not tend to adhere to such material, but such material also has fire proof characteristics.

DETAILED DESCRIPTION

Figure 1:
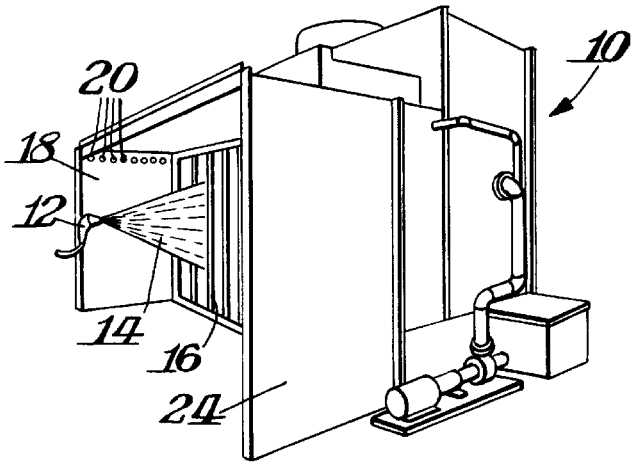
FIG. 1 is a perspective view of a paint spray booth in accordance with this invention.
Figure 5:
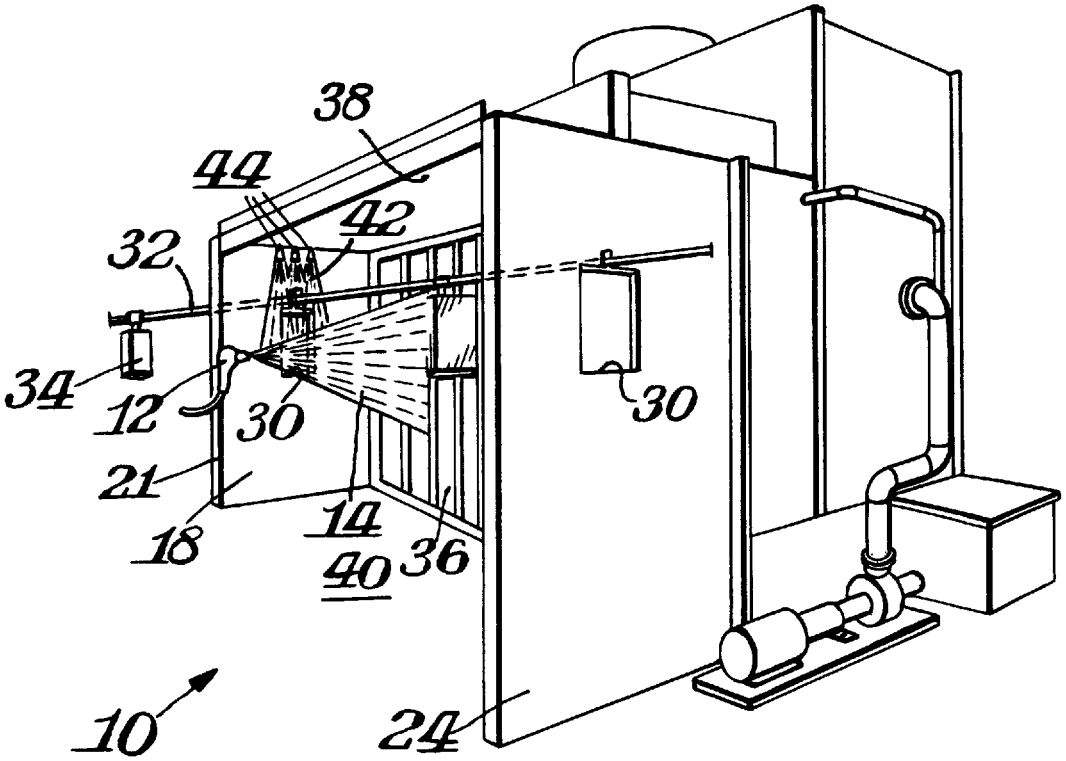
FIG. 5 is a view similar to FIG. 1 of a further paint spray both in accordance with this invention.

FIGS. 1 and 5 illustrate a paint spray booth 10 which could be of any known construction wherein means such as a paint spray gun 12 would be utilized for spraying objects in the paint spray booth. As shown, the paint leaving gun 12 would be in a spray pattern 14 and would not only contact the object being sprayed but also would contact the walls and other portions of and objects in the booth 10. The illustrated booth 10 includes stainless steel baffles 16 to create airflow for maximizing coverage.

FIG. 5 additionally shows the booth 10 to include cut-outs or openings 30 located in walls 21 and 24 at each end of booth 10. The openings 30 are shown as being generally rectangular, but could be of a shape having the silhouette or profile of the article 34 being painted. As also illustrated in FIG. 5, any suitable conveyor 32 would span across the walls 21 and 24 to convey the articles 34 from outside the booth 10 through the opening 30 in wall 21 where the article is then sprayed by the paint 14 from gun 12. The painted article then leaves booth 10 through opening 30 in exit wall 24. Preferably the enclosure which forms booth 10 would thus include at least walls 21 and 24 as well as intermediate wall 36 and ceiling 38. In addition, the floor 40 would be considered part of the enclosure. The booth 10 may be completely enclosed by an additional vertical wall interconnecting walls 21 and 24, if desired.

As also shown in FIG. 5 a downdraft of air 42 is provided through nozzles 44 mounted to the ceiling 38 of booth 10. The downdraft of air is used to minimize any overspray escaping from the booth.

Various aspects of such known booths 10 are described in U.S. Pat. Nos. 4,484,513, 4,207,833, and 4,469,595, the details of which are incorporated herein by reference thereto.

Figure 3:
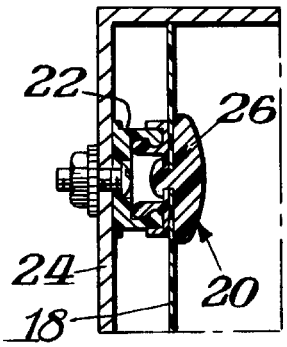
FIG. 3 is a cross-sectional view taken through FIG. 2 along the line 3—3.
Figure 2:
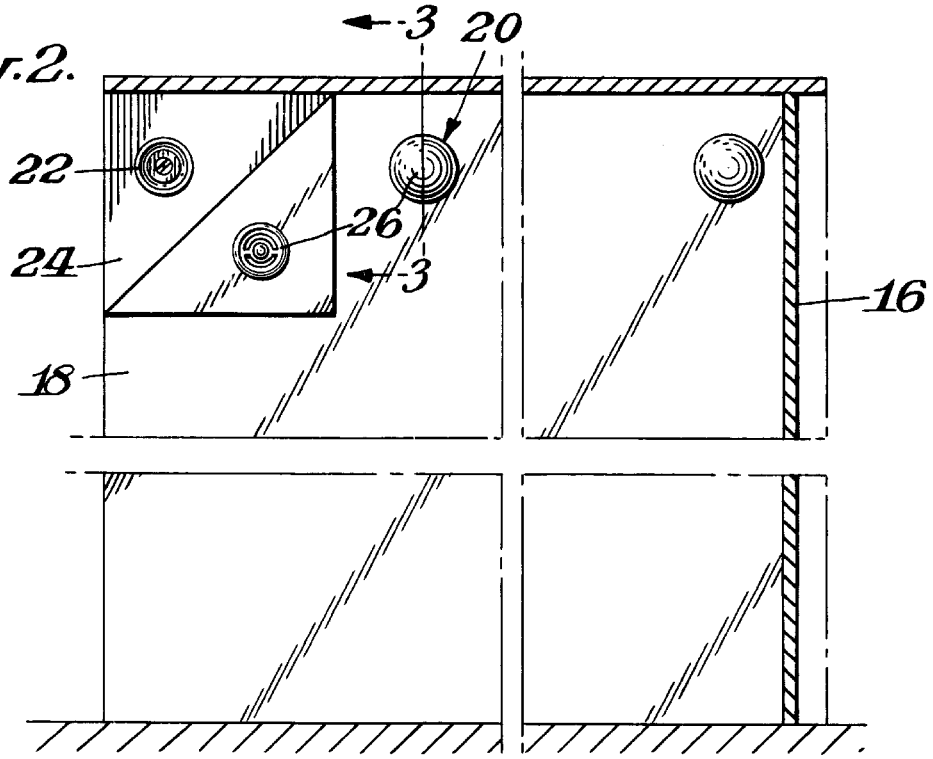
FIG. 2 is a fragmental side elevational view of the paint spray booth illustrated in FIG. 1 showing a snap fastening means of attachment of the curtain.

In accordance with this invention a protective curtain 18 is detachably mounted to one or more walls of the booth 10. In one embodiment of the invention illustrated in FIGS. 1–3 the curtain is mounted by means of snap fasteners 20 which would include, for example, a female receptacle 22 secured to the wall 24 and a male member 26 detachably received in female receptacle 22. In a known manner, male member 26 is secured to curtain 18. A plurality of such snap fasteners would be mounted at appropriate locations on the curtain and wall. FIG. 1, for example, illustrates the fasteners 20 to be at the upper edge of the curtain.

The invention may be practiced with the snap fasteners located at any suitable location such as the bottom, as well as the top. The plastic material for curtains 18 could be supplied in rolls with the snap fasteners already mounted to the plastic material. If desired, the mounting can be enhanced by utilizing magnetically attracted strips on the curtain which would be attracted to the metal wall. Such magnetic mounting means could be a supplement or alternative to the snap fasteners. The magnetic strips would be particularly advantageous where utilized at the lower end of the curtain to mount the base of the curtain magnetically while the upper end is mounted by the snap fasteners. Other locations along the side edges or in the central portions of the curtain may also be utilized to firmly secure the curtain in place.

Figure 4:
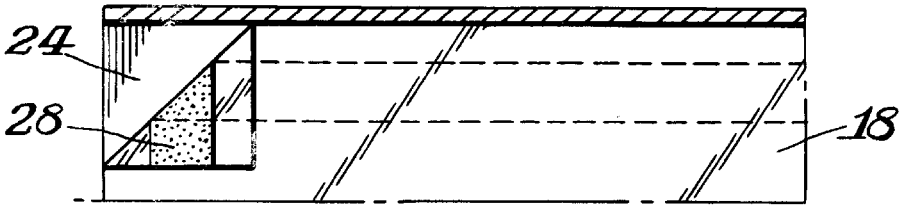
FIG. 4 is a view similar to FIG. 3 of a modified form of curtain in accordance with this invention.

FIG. 4 illustrates an alternative wherein a double face tape 28 is secured to the inner surface of the curtain 18 at suitable locations for mounting the curtain to the wall 24 of booth 10. The utilization of a strip of pressure sensitive adhesive would effectively function as a light duty manner of mounting the curtains.

Curtain 18 may be made of any suitable material such as being an adsorbent material made of PFP foam with a liquid impermeable barrier layer made, for example, from polyethylene. A particularly advantageous material is TEFLON® or PTFE to take advantage of the non-sticking characteristics as well as the fire proof characteristics of such material.

In one aspect of the invention a TEFLON® coating or other suitable material such as KAPTON (polyimide) or PFP which is knitted polyester cloth impermeable to liquids may be applied to the wall itself without an additional protective curtain. By using such material on the wall or the curtain the paint will tend to slide off or be easily washed off the exposed surface. Where a curtain itself is used made of material such as TEFLON® the curtain could last indefinitely by being readily cleaned where necessary in cases where there has been some adherence of the paint to the curtain since the paint could easily be removed from the curtain.

Although specific forms of mounting the curtain 18 to any of the walls in booth 10 have been described. It is to be understood that the invention may be practiced with various types of mounting structures. These include, for example, pressure sensitive adhesive, hooks, looping the top of the curtain and hanging it from a curtain rod, covering the walls with adhesive and in turn covering with the curtain, magnets, snaps, adhesive tape, VELCRO, spring clips, strings, nylon ties, twist ties, air pressure, suction, and static electricity.

As can be appreciated the present invention overcomes problems that have long plagued the prior art. In this regard, for years the overspray of paint in a spray booth has caused concern for automotive manufacturers without any real alternative solution. By providing a suitable curtain mounting arrangement, such as VELCRO or snap fasteners or the various other mounting means noted above around the perimeter of the walls with complementary fastening members affixed to the curtain, it is possible to provide sheets of clear plastic material acting as shields for the walls. This concept can be accomplished by cutting the sheets or curtains to fit any installation and can be cut to accommodate doors, shelves, hoses or virtually anything within the paint spray booth while allowing visual reference to the paint booth operation. The invention is easy to use, cost effective and environmentally friendly. The prior art has attempted to remove overspray by solvent based strippers and high pressure washing and by expensive masking. These techniques have resulted in significant down time. In contrast, with the present invention, when there has been a sufficient paint residue accumulated on the curtain the curtain is simply removed and readily replaced by a new curtain without any toxic material causing danger to the environment.

What is claimed is:

1. In a paint spray booth having a plurality of walls to define an enclosure, a conveyor in said enclosure to carry articles to be painted through said enclosure, said walls including a pair of oppositely disposed walls, an inlet opening in one of said pair of walls and an outlet opening in the other of said pair of walls with said conveyer being mounted therebetween, and a paint spray mechanism in said enclosure for paint spraying articles conveyed by said conveyor through said enclosure, the improvement being in that a protective curtain is mounted to at least one of said walls to minimize paint being sprayed against each wall having said protective curtain, said protective curtain being removably detachably mounted to its said wall to readily permit a fresh protective curtain to replace a protective curtain having paint sprayed thereon, and said curtain being made of a material having non-stick characteristics.

2. The booth of claim 1 including mounting members and complementary mounting members secured to said curtain and to each wall having said curtain mounted thereto for the removable detachable mounting of said curtain.

3. The booth of claim 2 wherein said mounting members include snap fasteners mounted on said curtain and complementary snap fasteners permanently mounted on its respective wall.

4. The booth of claim 2 wherein said mounting elements are secured at the top edge of said curtain.

5. The booth of claim 4 wherein said mounting elements are further secured at the bottom portion of said curtain.

6. The booth of claim 5 wherein said mounting elements are further secured at intermediate locations between said top edge and said bottom edge of said curtain.

7. The booth of claim 2 wherein said mounting elements include pressure sensitive tape.

8. The booth of claim 2 wherein said mounting elements include magnets.

9. The booth of claim 1 wherein said mounting is accomplished by static electricity.

10. The booth of claim 1 wherein said curtain is made of a material which is fire-proof.

11. The booth of claim 1 wherein said curtain is made of an absorbent material having a liquid impermeable barrier layer.

12. The booth of claim 1 including openings in said oppositely disposed walls of said booth are of silhouette shape corresponding to the shape of the articles being painted, and said booth including a downdraft assembly for applying air to said booth to minimize overspray escaping from said booth.

13. The booth of claim 12 wherein said booth includes at least three vertical walls and a roof, and said curtain mounted to a plurality of said vertical walls.

14. The booth of claim 1 wherein said curtain comprises a single layer of material.

15. The booth of claim 1 wherein said curtain comprises multi-layers in surface to surface contact with each other.

16. In a paint spray both having a plurality of walls to define an enclosure, a conveyor in said enclosure to carry articles to be painted through said enclosure, said walls including a pair of oppositely disposed walls, an inlet opening in one of said pair of walls and an outlet opening in the other of said pair of walls with said conveyer being mounted therebetween, and a paint spray mechanism in said enclosure for paint spraying articles conveyed by said conveyor through said enclosure, the improvement being in that at least one of said walls is covered by a protective barrier non-removably secured thereto, and said protective barrier comprising a liquid impermeable layer and an outer non-stick layer.

17. The booth of claim 16 including openings of silhouette shape in oppositely disposed walls of said booth corresponding to the shape of the articles being painted, and said booth including a downdraft assembly for applying air to said booth to minimize overspray escaping from said booth.

18. The booth of claim 17 wherein said booth includes at least three vertical walls and a roof and a plurality of said vertical walls having said protective barrier thereon.

19. The booth of claim 16 wherein said layers are in surface to surface contact with each other.

* * * * *